US005495717A

United States Patent [19]

Gottschlich et al.

[11] Patent Number: 5,495,717

[45] Date of Patent: Mar. 5, 1996

[54] INSULATED CONTAINER FOR STORING LIQUID HELIUM

[75] Inventors: Bernd Gottschlich, Betzdorf; Hans Lugmayr, Krefeld, both of Germany

[73] Assignee: Messer Griesheim GmbH, Frankfurt, Germany

[21] Appl. No.: 329,090

[22] Filed: Oct. 25, 1994

[30] Foreign Application Priority Data

May 4, 1994 [EP] European Pat. Off. ..... 94107013

[51] Int. Cl.[6] ..... F17C 7/02

[52] U.S. Cl. ..... 62/45.1; 62/50.1

[58] Field of Search ..... 62/51.1, 48.1, 62/50.1, 50.2, 45.1

[56] References Cited

U.S. PATENT DOCUMENTS

| | | | |
|---|---|---|---|
| 3,298,187 | 1/1967 | Short | 62/48.1 |
| 4,586,343 | 5/1986 | Buschkens et al. | 62/50.1 |
| 4,773,228 | 9/1988 | Murai et al. | 62/50.1 |

*Primary Examiner*—Ronald C. Capossela
*Attorney, Agent, or Firm*—Connolly & Hutz

[57] ABSTRACT

The invention relates to an insulated container (1) for storing liquid helium (2). In order to simplify the installation of a draw-off siphon and to permit drawing-off in an economical manner, according to the invention the draw-off siphon (3, 4) is at least partly fixedly integrated into the container (1) and thermally uncoupled relative to the environment.

20 Claims, 2 Drawing Sheets

INSULATED CONTAINER FOR STORING LIQUID HELIUM

BACKGROUND OF THE INVENTION

The invention relates to an insulated container for storing liquid helium.

Such containers for storing liquid helium have a neck-shaped opening for drawing off the liquid. For this purpose there is introduced into the container a draw-off siphon which reaches to the bottom of the container and which consists essentially of a vacuum-insulated tubular line having a vacuum closure and safety valve arranged at its top end. A filling tube is connected via a rigid or flexible intermediate piece to the draw-off siphon. In many cases the draw-off siphon is also provided with a shut-off valve.

At a boiling temperature of helium of approximately −269° C. a raised evaporation rate occurs during operation of the draw-off siphon, because the latter constitutes a temperature bridge to the atmosphere. According to U.S. Pat. No. 3,302,419 this rate should be lowered by cooling the draw-off siphon with evaporated medium. During stoppage times the container nevertheless still has a raised evaporation rate because of heat conduction to the liquid helium via the siphon tube. Cooling with evaporated medium gives no decisive benefit in this respect, because with modern helium containers having waste gas cooling the waste gas energy is already used up for cooling the insulation. For this reason it has hitherto been customary to store the draw-off siphon for helium containers outside the container and to insert the draw-off siphon into the container only when it is intended to draw off liquid helium.

This operation is dangerous (risk of combustion) because of the outflow of cold medium, and requires heavy expenditure for personnel and an appropriately high room, since the draw-off siphon has a height almost equal to that of the container and has to be inserted at container height into the neck-shaped opening of the container, or must be assembled from a plurality of parts screwed to one another for its insertion.

Whenever the draw-off siphon heated to ambient temperature is introduced, helium is evaporated.

SUMMARY OF THE INVENTION

The object on which the invention is based is therefore that of providing an insulated container for storing liquid helium, from which liquid helium can at any time be drawn off and with which this can be done with fewer personnel and with reduced risk, without having to accept the raised evaporation rate customary with integrated siphons.

The installation according to the invention permits rapid drawing-off of the liquid helium from the insulated container without a plurality of operators being required for the purpose.

In an advantageous manner the raised evaporation rate with fixedly installed draw-off siphons is lowered by thermal uncoupling of the draw-off siphon according to the invention. The thermal uncoupling is achieved in accordance with the invention with a draw-off siphon which consists of two parts, of which one part is movable relative to the other, while the thermal separation is effected through the distance between the two parts. The first part is fixedly installed in the container and extends from the bottom of the container to the lower end of the neck tube. This part can advantageously consist of a double-walled tube, in which during operation the air condenses and produces a vacuum. The bottom and the neck tube here serve as fastening bearings for the first part. The latter has at its top end, which is arranged in the bottom end region of the neck tube a cold-sealing connection part, for example a plug-in connection. By means of the connection part the first part can be coupled to the second part of the draw-off siphon according to the invention, for which purpose the second part has at its bottom end a counterpart to the connection part. The second draw-off siphon part adjoining the first part is taken to the outside through the draw-off opening of the container. The draw-off opening permits axial displacement of the second siphon part by means of a displacement device on the head of the container. The displacement device is advantageously in the form of a threaded bolt together with a cap nut, by means of which simple performance of the uncoupling operation is ensured. The guiding of the top siphon part in the threaded bolt and a conical insertion opening ensure that the siphon parts meet. By means of the cap nut an axial sealing force can be exerted for the connection part. The draw-off siphon according to the invention is connected to a filling tube by means of a flexible or rigid connection line and a shut-off device. The connection line with the filling tube is fixed securely and in a protected manner on the container during transport. The second part of the draw-off siphon of the invention can also be removed from the container if over long periods of time no helium is drawn off. The economic advantages are also gained in respect of the removal of the second part, since the latter has only a length equal to that of the neck of the container and thus can in a simple manner be inserted by one operator into the draw-off opening of the container and connected to the first part. Since the second part has a substantially shorter length than a one-piece draw-off siphon, its storage outside the container is also possible without causing problems, so that bending or kinking of the tubular line in daily operation is made impossible.

The separation point between the first and second parts of the siphon according to the invention can also be arranged in a higher position in the neck tube or in the head of the container, and also below the neck tube, in order to permit only slight admission of heat into the liquid helium on thermal separation from the second part. In this connection it is in addition advantageously possible for the draw-off siphon according to the invention to be designed as a telescope which, after the drawing-off operation, can be collapsed in the container, particularly below the level of the liquid or in the neck region, and be extended as far as the draw-off opening or into the liquid. The variations of the length of the telescope can be made with the aid of a simple tool.

THE DRAWINGS

One exemplary embodiment is described more fully below and illustrated in the drawing, in which:

FIG. 1 shows an insulated container according to the invention, with an integrated siphon part, FIG. 2 shows on a larger scale the displacement device shown in FIG. 1 within the circle indicted by II in FIG. 1.

DETAILED DESCRIPTION

Figure 1:
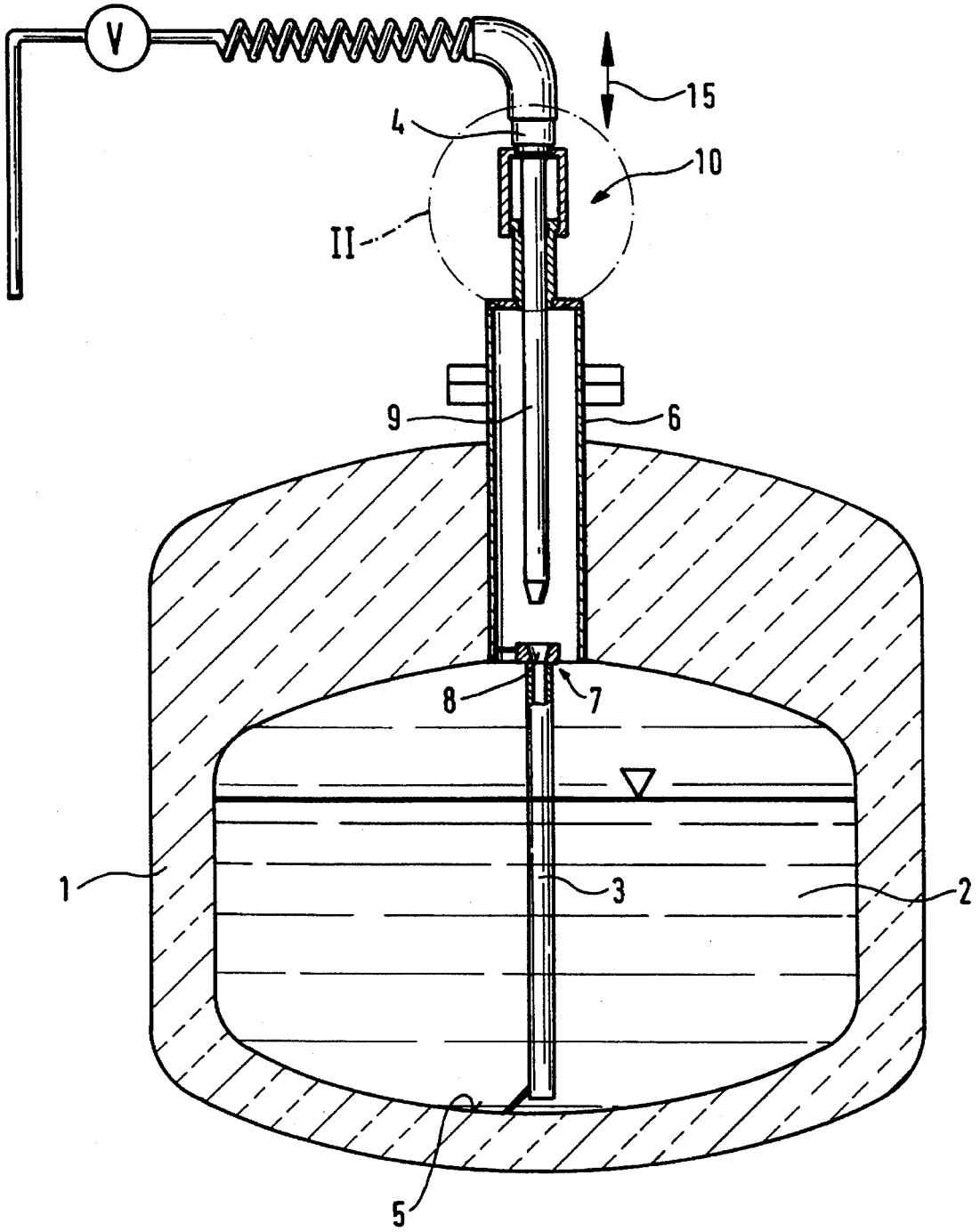

The drawing shows an insulated container 1, in which liquid helium is contained. The siphon according to the invention, which permits the drawing-off of liquid helium 2, consists of a first part 3 and a second part 4. The first part 3 is fastened to the bottom 5 of the container 1 and to the bottom end of the neck tube 6. Through this arrangement the first part 3 of the draw-off siphon is guided into the end region of the neck tube. The top end of the first part 3 then lies outside the liquid helium 2. At its top end the first part 3 is designed as a connection part 7, which advantageously has means facilitating insertion, in the form of an enlarged conical insertion opening 8 for easier coupling to the counterpart 9. The counterpart 9 is arranged at the bottom end of the second part 4. The connection part 7 and the counterpart 9 constitute a cold-sealing plug-in connection. The seal of the counterpart 9 may be conical or cylindrical. The second part 4, which adjoins the first part 3, leads to the outside via a displacement device 10. The displacement device 10, for the thermal uncoupling of the second part 4 from the first part 3 of the draw-off siphon, consists essentially of a threaded bolt 11, which is arranged on the head of the container 1 and has a central bore 12 guiding the second part 4, and of a cap nut 13 which is arranged on the second part 4 and is adjustable on the threaded bolt 10. Between the central bore 12 serving as guide and the top end of the second part 4 at least one radial seal 14 is arranged.

It is obvious, and needs no further description, that other constructional variants of the displacement device also exist, such as for example the reverse solution in which the cap nut is arranged on the head of the container, or the provision of inclined planes instead of a screw thread connection.

Figure 2:
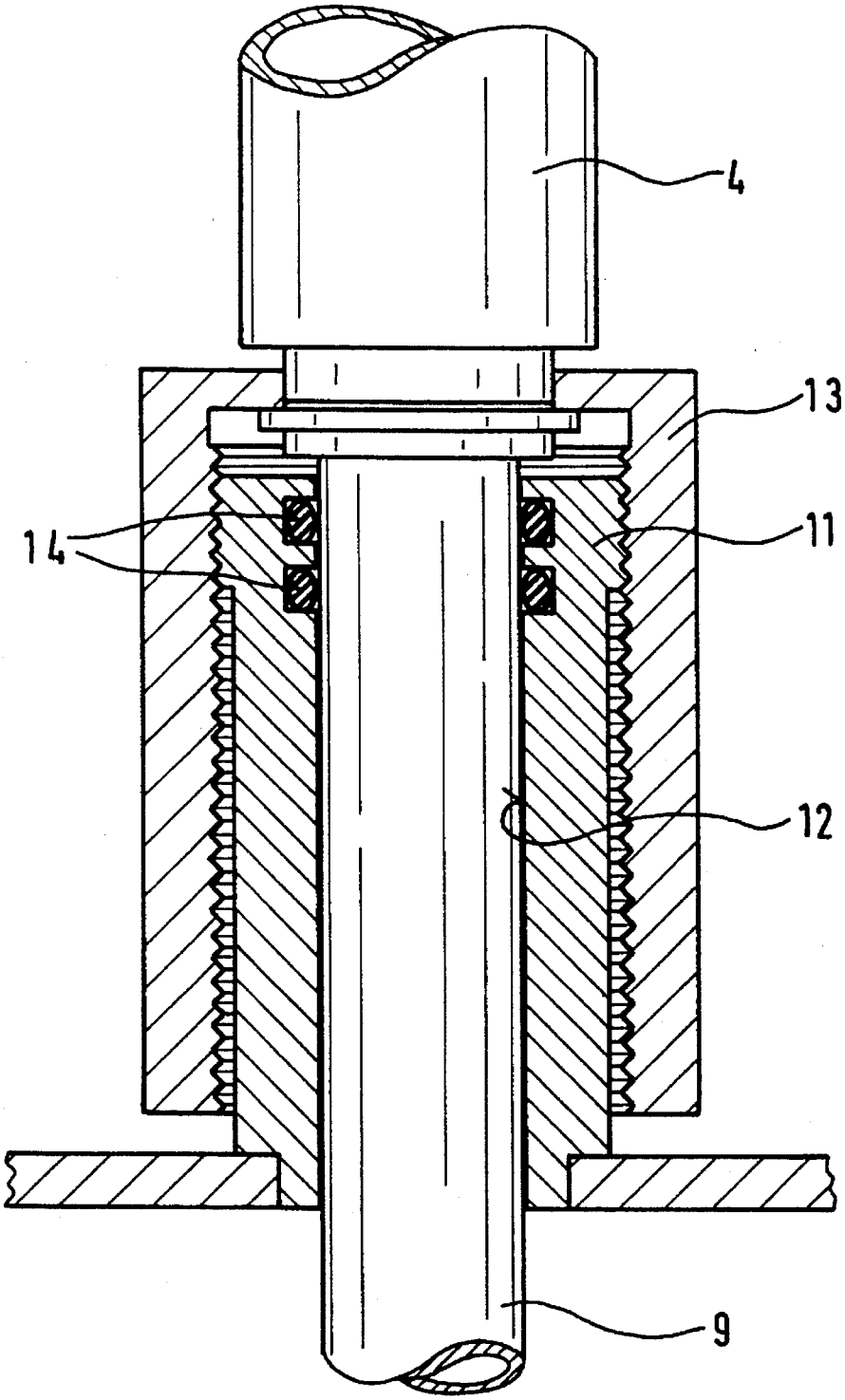

The displacement device 10 permits the axial displacement of the top siphon part 4 in the vertical direction into the connection part 7 and back out of the latter. The displacement is effected with the aid of the cap nut 13, which is endlessly rotatable on the top siphon part 4 and which, as illustrated in FIG. 1, is turned upwards in the direction of the arrow 15 on the threaded bolt 11 for the thermal uncoupling of the second part 4 of the draw-off siphon from the first part 3. The central bore 12 provided in the threaded bolt 11 guides the second part 4 such that when the cap nut 13 is screwed onto the threaded bolt 11, as illustrated in FIG. 2, accurate insertion of the top siphon part 4 into the conical insertion opening 8 of the connection part 7 is ensured. If the counterpart 9 has a conical configuration and therefore forms a conical seal, the necessary sealing power can be produced by means of the cap nut 13 on the head of the container 1.

As can be seen in the drawing, this second part 4 of the draw-off siphon can also be removed from the insulated container 1 and stored at the side of the insulated container. The user is thus given the advantage that the relatively short second part 4 can be installed or detached in a simple manner by a single operator. In addition, when it is stored outside the container 1, the second part 4, because of its short length, is not bent out of shape.

According to another exemplary embodiment, which is not further illustrated, the draw-off siphon according to the invention is designed as a telescope, which after the drawing-off operation is collapsed to a point under or above the level of liquid at the time in question, and which in order to draw off liquid is extended. Through the collapsing of the draw-off siphon to a point under or above the level of the liquid helium the advantage is gained that thermal bridges are not formed when the draw-off siphon is out of operation.

We claim:

1. An insulated container for storing liquid helium comprising a container for the helium, the container having an upper end, a draw-off siphon mounted to the upper end of the container, the draw-off siphon including a first part and a second part, the first part being a lower part extending into the container for contacting the liquid helium in the container, the second part being an upper part extending out of the container into the environment outside of the container, the first part and the second part being in flow communication with each other for the drawing-off of the liquid helium from the container, and the second part being thermally separated from the first part to prevent heat conduction from the second part to the first part and then into the container.

2. The insulated container as claimed in claim 1, wherein the two parts are movable relative to one another.

3. The insulated container as claimed in claim 2, wherein the upper end of the container has a neck tube, the first part extends from the bottom of the container to the bottom end of the neck tube and has a connection part by means of which the first part can be coupled to complementary structure provided on the second part, and the second part extends to the outside of the container via the draw-off opening.

4. The insulated container as claimed in claim 3, wherein the first part is fixed to the bottom and to the neck tube.

5. The insulated container as claimed in claim 4, wherein the connection of the two parts consists of a cold-sealing plug-in connection.

6. The insulated container as claimed in claim 5, wherein the connection part has means facilitating insertion.

7. The insulated container as claimed in claim 6, wherein the connection part has a conical insertion opening.

8. The insulated container as claimed in claim 6, wherein the second part can be positioned by means of a displacement device in a position thermally separated from the first part.

9. The insulated container as claimed in claim 8, wherein the displacement device consists of a threaded bolt which is arranged on the container and guides the second part, and the second part carries a cap nut which is adjustable on the threaded bolt.

10. The insulated container as claimed in claim 9, wherein the threaded bolt has a central bore in which the second part is guided.

11. The insulated container as claimed in claim 10, wherein at least one radial seal is arranged between the central bore and the second part.

12. The insulated container as claimed in claim 1, wherein the upper end of the container has a neck tube, the first part extends from the bottom of the container to the bottom end of the neck tube and has a connection part by means of which the first part can be coupled to complementary structure provided on the second part, and the second part extends to the outside of the container via the draw-off opening.

13. The insulated container as claimed in claim 1, wherein the first part is fixed to the bottom of the container and to a neck tube at the upper end of the container.

14. The insulated container as claimed in claim 1, wherein the connection of the two parts consists of a cold-sealing plug-in connection.

15. The insulated container as claimed in claim 14, wherein the connection part has means facilitating insertion.

16. The insulated container as claimed in claim 15, wherein the connection part has a conical insertion opening.

17. The insulated container as claimed in claim 1, wherein the second part can be positioned by means of a displacement device in a position thermally separated from the first part.

18. The insulated container as claimed in claim 17, wherein the displacement device consists of a threaded bolt which is arranged on the container and guides the second part, and the second part carries a cap nut which is adjustable on the threaded bolt.

19. The insulated container as claimed in claim 18, wherein the threaded bolt has a central bore in which the second part is guided.

20. The insulated container as claimed in claim 19, wherein at least one radial seal is arranged between the central bore and the second part.

* * * * *